US006718869B1

(12) United States Patent
Laitio et al.

(10) Patent No.: US 6,718,869 B1
(45) Date of Patent: Apr. 13, 2004

(54) TAIL THREADING METHOD AND FINISHING DEVICE FOR PAPER

(75) Inventors: Juha Laitio, Espoo (FI); Ismo Kallio, Espoo (FI); Veli-Pekka Koljonen, Kärnä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/581,605

(22) PCT Filed: Dec. 15, 1998

(86) PCT No.: PCT/FI98/00984

§ 371 (c)(1),
(2), (4) Date: Jun. 15, 2000

(87) PCT Pub. No.: WO99/31317

PCT Pub. Date: Jun. 24, 1999

(30) Foreign Application Priority Data

Dec. 15, 1997 (FI) ..... 974520

(51) Int. Cl.[7] ..... B30B 11/22

(52) U.S. Cl. ..... 100/41; 100/173; 100/176

(58) Field of Search ..... 100/173, 162 R, 100/163 R, 35, 41, 161, 155 R, 176; 162/205, 286, 193, 283; 226/5, 7, 91, 97, 92

(56) References Cited

U.S. PATENT DOCUMENTS

| | | | | | |
|---|---|---|---|---|---|
| 3,625,813 | A | | 12/1971 | Eckelman | 162/286 |
| 3,999,696 | A | * | 12/1976 | Reba et al. | 226/196.1 |
| 4,014,487 | A | * | 3/1977 | Reba et al. | 226/110 |
| 4,186,860 | A | * | 2/1980 | Reba | 226/7 |
| 4,332,191 | A | | 6/1982 | Kankaanpaa | 100/162 R |
| 4,726,502 | A | * | 2/1988 | Cryderman | 162/193 |
| 4,763,822 | A | * | 8/1988 | Mohrsen | 162/286 |
| 4,913,329 | A | * | 4/1990 | Cahill et al. | 131/84.1 |
| 5,234,549 | A | | 8/1993 | Weldon | 162/193 |
| 5,438,920 | A | | 8/1995 | Koivukunnas et al. | 100/38 |

FOREIGN PATENT DOCUMENTS

| | | | |
|---|---|---|---|
| FI | 95612 | 11/1995 | D21F/7/00 |
| WO | 910335 | 3/1991 | B26F/3/00 |

* cited by examiner

*Primary Examiner*—Allen Ostrager
*Assistant Examiner*—Shelley Self
(74) *Attorney, Agent, or Firm*—Steinberg & Raskin, P.C.

(57) ABSTRACT

In the method for threading a tail (7) of a paper or board web through a paper or board machine or a section thereof, or through an aftertreatment machine for paper or board or a section thereof, the tail (7) is prevented from wandering onto the same line with a tail carrier means (8, 9), such as threading ropes, upstream of the draw point of the tail. The tail (7) is guided towards the centre line of the machine by subjecting the tail to an effect of force which tends to move the tail towards the centre line of the machine.

8 Claims, 4 Drawing Sheets

TAIL THREADING METHOD AND FINISHING DEVICE FOR PAPER

FIELD OF THE INVENTION

The invention relates to an improvement in the tail threading method used in paper and board machines and to a finishing device for paper, especially a multi-roll calender, placed in a paper or board machine or in an aftertreatment machine of paper or board and applying the improved tail threading method.

BACKGROUND OF THE INVENTION

The FI patent 62874 of the applicant discloses a calender for paper or the like, which is intended to be integrated in a paper or board machine to calender the web passed from the same. The calender utilizes a threading method, which comprises two endless ropes which are arranged to travel in the vicinity of one vertical frame column of the calender guided by rope sheaves and via grooves located on the mantles of the calender rolls. According to the specification, the threading takes place in such a way that the calender nips are open and the calender rolls rotate at a speed corresponding to the feed rate of the web in the paper machine, i.e. they are driven. A narrow strip of the web passed from the drying section of the paper machine is guided into the gap or throat between the ropes at the stage when the ropes are guided to the rope groove of the roll. This so-called tail travels between the ropes and follows their path as they are winding via the calender rolls in accordance with the travel path of the web according to the function of the calender.

Futhermore, a slightly more modem calender concept which can be placed within the paper machine, is disclosed in the FI patent 96334 by the applicant, which describes a multi-roll calender provided with modem roll coatings, and applying rolls with both hard and soft surfaces. Naturally, when placing the calender according to this invention within the paper machine, it should include for example a threading system according to the FI patent 62874 which is capable of performing threading when the web runs at the driving speed of the paper machine, which can even exceed the value of 2000 m/min.

In such a threading method, the tail does not travel along a straight path but winds i.e. bends in directions perpendicular to its plane, in such a way that the transverse stiffness of the tail ceases to affect the travel of the tail. Thus even the weakest lateral forces that affect the tail can move the tail in the lateral direction during threading. The characteristics of the tail can be compared to a flexible lath which, when in a straight position, functions like a bending beam when being subjected to lateral forces, but when it is placed in a bent position, its stiffness which still resists the transverse force, is due to the torsional stiffness effective in the cross-sectional plane of the lath, wherein a considerably weaker transverse force is required to deflect the end of the lath when compared to a plain bending situation.

The lateral forces effective on the tail in the paper machine are produced for example by currents of air developed in the paper machine by friction between the surfaces of rapidly rotating rolls and the surrounding air, and by the different temperatures of various machine sections, as well as by the differences in the temperatures of the machine sections and ambient air.

It has been observed that the air flows tend to move the web off the machine in the cross machine direction, especially in the vicinity of such points where two rolls rotating in opposite directions are located close to each other. An example that can be mentioned is a calender nip which is open during threading.

The tail is separated from the full-sized web in a suitable location in the machine section preceding the calender, for example in the drying section, with a cutting means which separates a strip of a particular width from the edge of the web. The forward end of this strip is guided between continuous threading means, such as ropes, belts, or the like, in order to draw the tail even long stretches in the future travel path of the web. Thus, a problem in the threading methods of prior art is that when the tail is passed by means of ropes, belts, or the like, through the calender or a corresponding paper processing device, the tail following the forward end placed in the threading means tends to wander onto the same line with the threading means again: underneath, above or between the same, in the travel direction of the tail behind the actual draw point where it should settle on the correct route for example between the rolls. The tail breaks easily at this point and the threading attempt has to be initiated again.

When this strip which runs freely and in a relatively uncontrolled manner in the end section of the tail, ends up on the same line with the threading means, for example on top of them, the strip may still be located on the top i.e. in a free position on the next reversing roll, but thereafter on the next one, the strip may already be located between the threading means and their guide means, i.e. belt or rope sheaves. The belt or rope sheaves or the other guiding devices of the threading means are provided with such a structure that their outer diameter corresponds to the outer diameter of the roll by which they are placed in the bend or reversing point of the path and along which the tail travels, and they contain a groove whose bottom, however, has a smaller diameter than the diameter of the corresponding roll. Therefore, the speed of the tail is reduced when it is ends up between the threading means and its guiding device, and as a result, the tail is tightened and breaks because the actual forward end of the tail is running at the surface speed of the rolls. Correspondingly, the tail is slackened in the travel direction of the web after the aforementioned disturbance point, thus causing an increasing tendency of the tail to wander as the tightness is lost.

Due to the above-described phenomena, it is most likely that the tail will break in this disturbance situation.

U.S. Pat. No. 5,234,549 discloses a so-called dual cutter comprising two cutting blades, intended for separating the tail from the web. By means of this dual cutter it is possible to affect the location of the tail in the cross direction of the machine by moving the blade separating the tail from the wide web closer to the centre, and by cutting a narrow strip from the wide strip so obtained at its outer edge. The edge strip to be conveyed to the calender moves in this way closer to the centre in the cross-machine direction. Thus, this arrangement requires two independently movable cutting blades.

OBJECTS AND SUMMARY OF THE INVENTION

It is an objective of the invention to produce a threading method and a finishing device for paper, by means of which it is possible to prevent the tail from breaking due to the aforementioned reasons during threading. Furthermore, an objective of the invention is to produce a threading method and a finishing device for paper whereby it is possible to prevent the tail from wandering outwards with respect to the centre line of the machine during tail transfer before spreading the web to its full width, also in cases where only a single cutter is available, i.e. in conventional threading operations where a tail narrower than the rest of the paper or board web is separated from the outer edge of the web along a single cutting line.

BRIEF DESCRIPTION OF THE DRAWINGS

In the following, the invention will be described in more detail with reference to the appended drawings, in which.

DETAILED DESCRIPTION OF THE INVENTION

Figure 1:
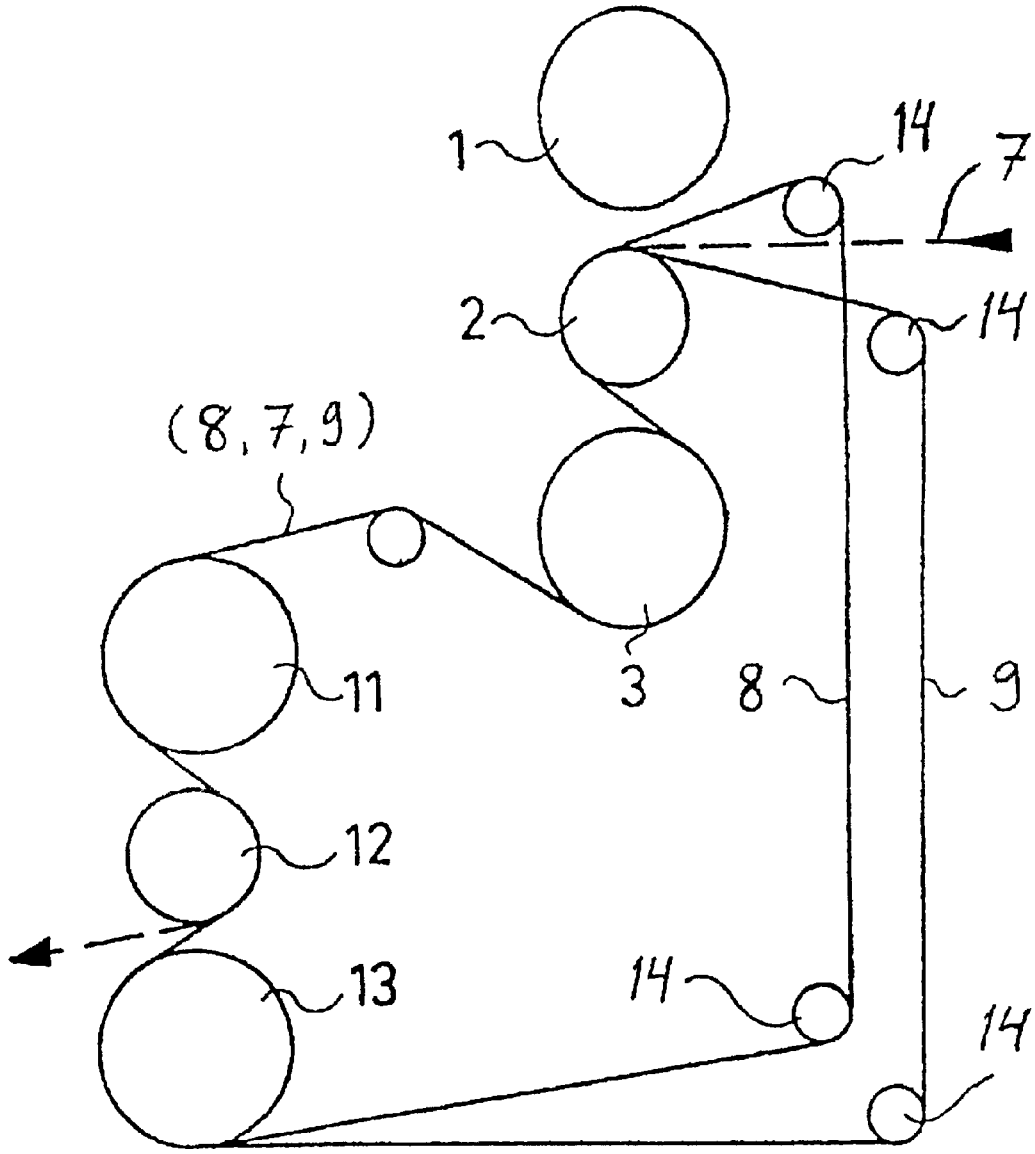
FIG. 1 shows a tail threading method of prior art.

FIG. 1 shows diagrammatically the course of a threading rope system of prior art in a calender application according to the FI patent 62874. The rope guide system of the calender includes two endless ropes 8 and 9 which are arranged to travel in the vicinity of one vertical frame column of the calender, guided by rope sheaves 14, and via grooves located in the mantles of the rolls. FIG. 1 shows the calender at the start-up stage, wherein the nips are open. A narrow web strip, i.e. the tail 7 coming from the drying section, is passed into a gap or throat between the ropes 8 and 9 at the stage when these ropes are guided into a rope groove in the roll 2. This tail 7 travels between the ropes 8, 9 and follows their path as they wind via the calender rolls in accordance with the travel path of the web corresponding to the function of the calender. When the travel of the web through the calender is secured, the nips are closed for calendering. In the lead-through stage of the web, the rolls 1, 2, 11, 12 have to be positively driven. As was presented above, they may each have a drive motor of its own which is advantageously a variable-speed motor, or they may be driven for example by means of belt transmission from rolls 3 and 13 respectively, equipped with main drive motors.

Figure 2:
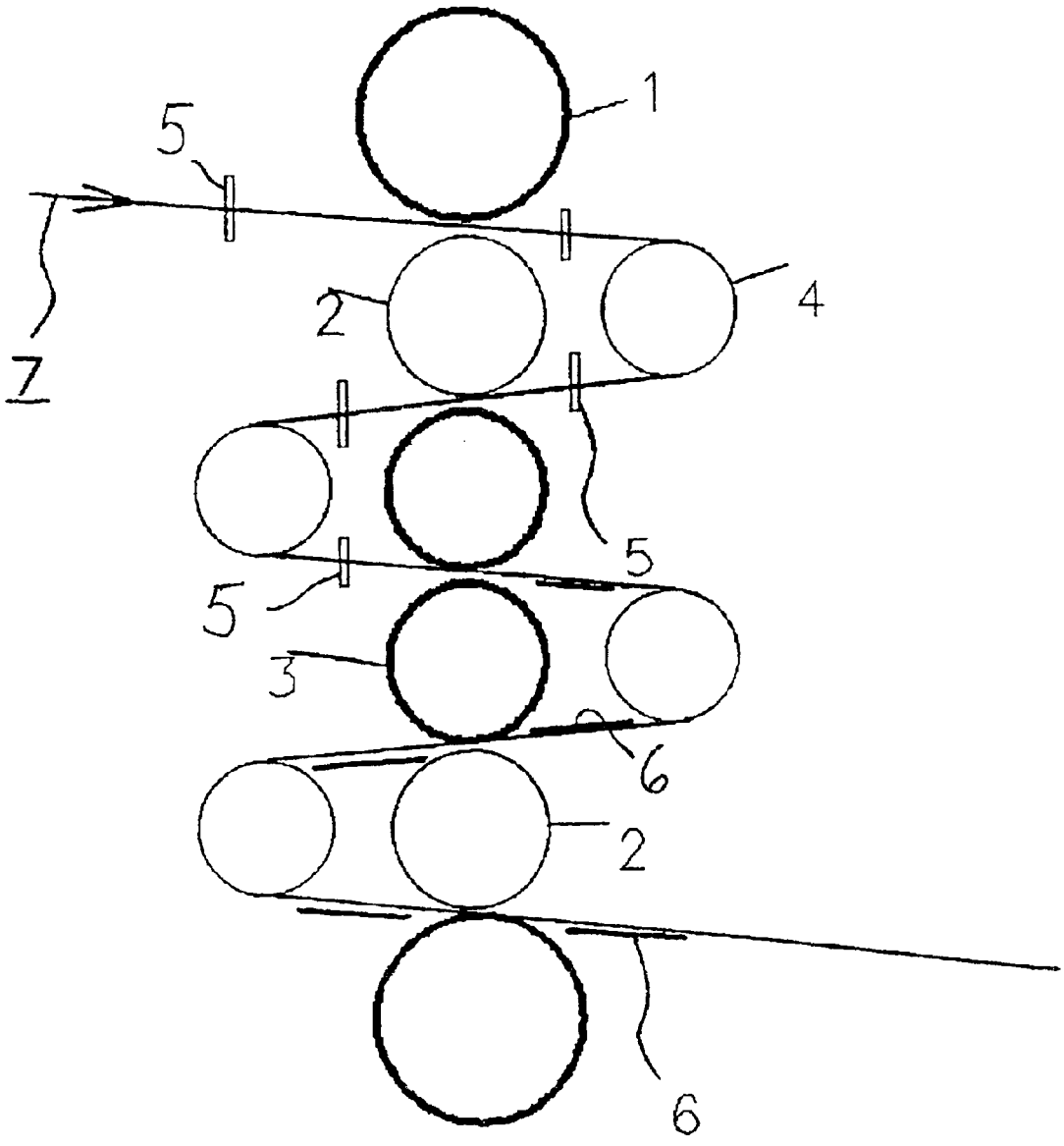
FIG. 2 shows a tail threading method according to the invention in the calender.
Figure 3A:
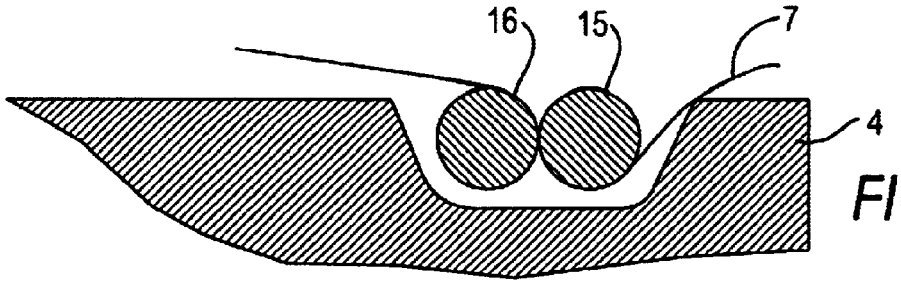
FIGS. 3*a*–3*d* show a schematical view of the attachment of the forward end of the tail to the tail threading means, and the correct location and incorrect locations of the rear portion of the tail with respect to the threading means.
Figure 3B:
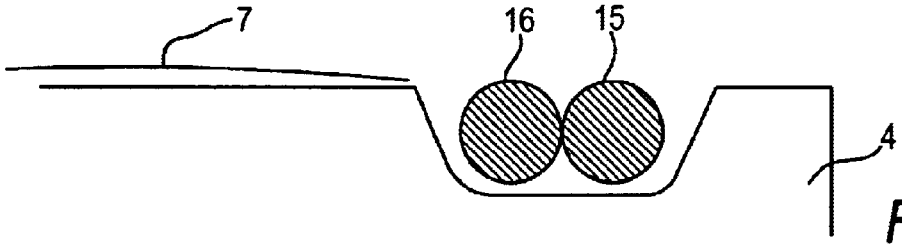
Figure 3C:
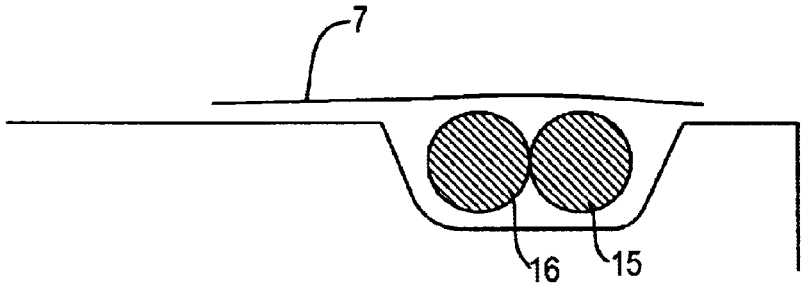
Figure 3D:
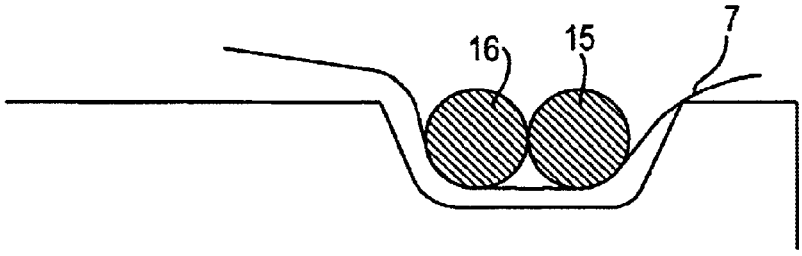

The calender according to the invention applies the same principle for guiding a narrower tail 7 separated from the web along a winding path determined by the calender rolls. FIG. 2 shows a tail threading method according to the invention in the calender. In this case, the calender is composed of a substantially vertical stack of rolls, in which the topmost roll 1 is a variable crown roll provided with a soft coating which can be made of materials of prior art: from sheets of natural fibre by pressing or of thermosetting plastics and/or thermoplastics. Here, the intermediate rolls of the calender are temperature-controlled rolls 2 with metal or ceramic surfaces, and intermediate non-variable crown rolls 3 with soft coatings. Furthermore, in this calender the web is guided between the nips onto so-called take-out leader rolls 4, by means of which it is possible to subject the web to a spreading effect and to prevent the temperature of the web from rising excessively. The tail 7 is passed along the future path of the web. In the machine section preceding the calender in a paper or board machine or a paper or board aftertreatment machine, the tail has been separated from the full-width web for example by means of a cutter, and the remaining web is discharged as broke before the calender. The forward end of the tail separated from the rest of the web in this way is fed between two continuous threading means forming endless loops according to FIG. 1. The threading takes place in such a way that the nips between the rolls in the stack of rolls are open, and the rolls are rotating at a speed corresponding to the feed rate of the paper or board machine or an aftertreatment machine for paper or board by being driven.

FIG. 2 also shows advantageous locations for the guide means 5, 6 for the tail. The guide means 5 symbolizes the alternative in which blow nozzles are placed by the side of the travel path of the web, outwardly of the carrier means i.e. threading means for its tail 7. The blow nozzles effect an air current in the cross direction of the web towards the centre line of the calender, which air current tends to move the tail 7 further from the carrier means of the tail. The second guide means 6 symbolizes an alternative where the tail 7 is guided with guide means placed in the cross direction of the machine on the travel path of the tail. These guide means 6 can be nozzles according to FIG. 4c, based on the "Coanda" effect, or guide plates based on a mechanical contact only. As can be seen in FIG. 2, the guide means 5, 6 are placed in those portions where the tail 7 travels alongside the threading means free from the surfaces guiding the tail, for example in the portions between the nips of the rolls 1–3 and the take-out leader rolls 4, before the first open nip and after the last open nip.

FIGS. 3*a*–3*d* show schematically the attachment of the forward end of the tail 7 to the continuous threading means 8, 9 (FIG. 3*a*) and, in relation to the continuous threading means 15, 16 the correct position of the rear portion of the tail 7 (FIG. 3*b*), as well as incorrect positions (FIGS. 3*c* and 3*d*) of the same, which are due to the estate of art. The drawing shows the travel of the tail 7 at the take-out leader roll 4, and the location of the threading means 15, 16 in the groove at the end of the take-out leader roll.

Figure 4A:
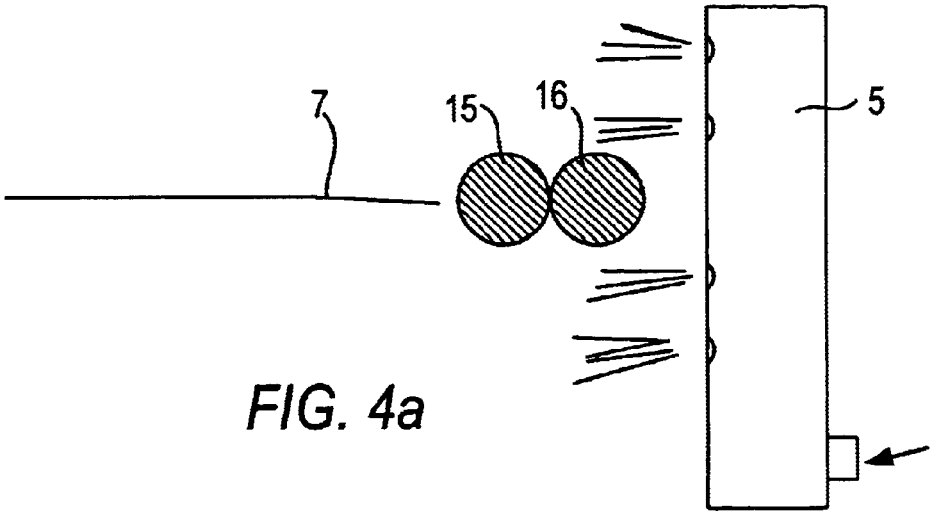
FIGS. 4*a*–4*c* show guide means of the tail which are based on blowing.
Figure 4B:
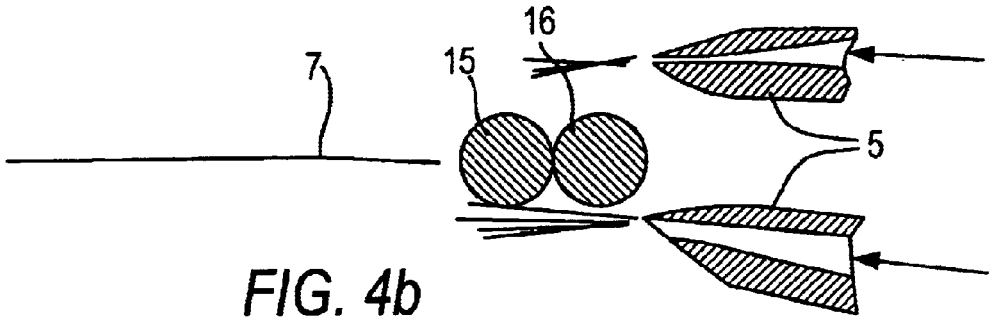
Figure 4C:
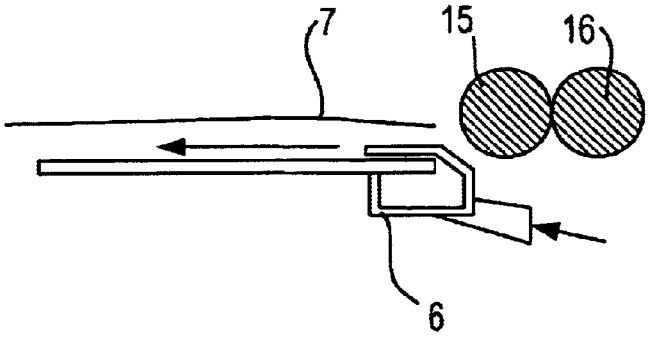

FIGS. 4*a*–4*c* show guide means for the tail which are based on blowing. FIGS. 4*a* and 4*b* show guide means 5, which are blow nozzles placed by the side of the future travel path of a paper or board web outwardly of its tail threading means 15, 16 the blow nozzles producing an air current in the cross direction of the web towards the centre line of the calender, which air current tends to move the tail 7 further away from the tail threading means 15, 16. The blow nozzles of FIG. 4*a* open from a common blow box to which pressurized air, or the like, is led. The blow nozzles generate a blowing on both sides of the plane of the tail 7.

In FIG. 4, the blow nozzles are separate nozzles which are directed in the cross machine direction on both sides of the plane of the tail 7. FIG. 4*c*, in turn, shows an alternative in the tail is guided with guide means 6 placed in the cross direction of the machine on the travel path of the tail 7. These guide means 6, which can be located underneath or above the tail, can be nozzles based on the "Coanda" effect according to FIG. 4*c*, or guide plates based solely on mechanical contact. Such guide plates can, for example, be rapidly moved to a position where they prevent the tail from touching the threading means 15, 16 after the draw point.

After the tail 7 has been threaded through the entire calender and its travel is normal, the paper or board web is spread into the full width by means of diagonal cutting conducted in the preceding machine section. After that, the nips between the rolls 1, 2, and 3 can be closed and the calendering of the web can be started.

What is claimed is:

1. A method for threading a tail of a paper or board web in a paper or board machine or in a aftertreatment machine for paper or board comprising the steps of:

feeding a forward end of a tail that is narrower than a full-width paper or board web between two continuous threading means to provide a draw point of the tail;

guiding the tail towards a center line of the machine by subjecting the tail that is running along side said continuous threading means, after the draw point, to an external centering force, said centering force being directed in a cross direction of the web for moving the tail towards a center line of the machine away from said continuous threading means.

2. The method according to claim 1, wherein said external centering force directed in a cross direction of the web comprises a blowing force generated by directing a current of gaseous medium towards said tail to move said tail towards said center line.

3. The method according to claim 1, wherein said external centering force is generated by mechanical guide means placed along a travel path of the tail.

4. A finishing device for a paper or board machine or an aftertreatment machine for paper or board comprising:

a path for a paper or board web defining a running direction of the web through the finishing device or the aftertreatment machine;

a threading apparatus comprising means for drawing a tail portion of the web from a draw point along said path; and means arranged, with respect to said running direction, in an upstream direction relative to said draw point at a location where said tail portion runs alongside said threading apparatus for guiding the tail in a cross direction of the web towards a center line of the machine and away from the threading apparatus.

5. The finishing device according to claim 4, wherein said means for guiding the tail towards a center line of the machine comprises at least one blow nozzle structured and arranged to direct a flow of a gaseous medium in a cross direction of the web.

6. The finishing device according to claim 4, wherein said means for guiding the tail towards a center line of the machine comprises at least one nozzle structured and arranged to produce a Coanda effect.

7. The finishing device according to claim 4, wherein the means for guiding the tail towards a center line of the machine comprise mechanical guide means arranged along a travel path of the tail narrower than a full width paper or board web for directing the tail towards said center line of the machine.

8. The finishing device according to claim 4, wherein said finishing device comprises a multi-roll calender having calender rolls, said path for a paper or board web being a winding path determined by the calender rolls.

* * * * *